US010352161B2

(12) United States Patent
Zuo et al.

(10) Patent No.: US 10,352,161 B2
(45) Date of Patent: Jul. 16, 2019

(54) APPLYING SHRINKAGE FACTOR TO REAL-TIME OBM FILTRATE CONTAMINATION MONITORING

(71) Applicant: Schlumberger Technology Corporation, Sugar Land, TX (US)

(72) Inventors: Youxiang Zuo, Burnaby (CA); Adriaan Gisolf, Houston, TX (US); Kang Wang, Beijing (CN); Ryan Sangjun Lee, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 682 days.

(21) Appl. No.: 14/975,704

(22) Filed: Dec. 18, 2015

(65) Prior Publication Data

US 2016/0186560 A1 Jun. 30, 2016

Related U.S. Application Data

(60) Provisional application No. 62/098,213, filed on Dec. 30, 2014.

(51) Int. Cl.

| | |
|---|---|
| ***E21B 49/10*** | (2006.01) |
| ***E21B 47/12*** | (2012.01) |
| *E21B 49/08* | (2006.01) |

(52) U.S. Cl.

CPC ..... *E21B 49/10* (2013.01); *E21B 2049/085* (2013.01)

(58) Field of Classification Search

CPC .. E21B 49/10; E21B 2049/085; E21B 49/081; E21B 49/08

See application file for complete search history.

(56) References Cited

U.S. PATENT DOCUMENTS

| | | | |
|---|---|---|---|
| 7,586,087 | B2 | 9/2009 | Dong et al. |
| 7,913,556 | B2 | 3/2011 | Hsu et al. |
| 7,920,970 | B2 | 4/2011 | Zuo et al. |
| 7,966,273 | B2 | 6/2011 | Hegeman |
| 8,434,356 | B2 | 5/2013 | Hsu et al. |
| 9,557,312 | B2 | 1/2017 | Zuo et al. |
| 9,606,260 | B2 | 3/2017 | Zuo et al. |
| 9,784,101 | B2 | 10/2017 | Jackson et al. |

(Continued)

*Primary Examiner* — Zakiya W Bates
(74) *Attorney, Agent, or Firm* — Michael Dae

(57) ABSTRACT

A downhole tool operable to pump a volume of contaminated fluid from a subterranean formation during an elapsed pumping time while obtaining in-situ, real-time data associated with the contaminated fluid. The contaminated fluid includes native formation fluid and oil-based mud (OBM) filtrate. A shrinkage factor of the contaminated fluid is determined based on the in-situ, real-time data. The contaminated fluid shrinkage factor is fit relative to pumped volume or pumping time to obtain a function relating the shrinkage factor with pumped volume or elapsed pumping time. A shrinkage factor of the native formation fluid is determined based on the function. A shrinkage factor of the OBM filtrate is also determined. OBM filtrate volume percentage is determined based on the shrinkage factor of the native formation fluid and the shrinkage factor of the OBM filtrate.

20 Claims, 7 Drawing Sheets

(56) References Cited

U.S. PATENT DOCUMENTS

| | | | | |
|---|---|---|---|---|
| 2006/0149476 | A1* | 7/2006 | Gibbs | E21B 47/0008 702/6 |
| 2015/0142317 | A1 | 5/2015 | Zuo et al. | |
| 2015/0211361 | A1 | 7/2015 | Gisolf et al. | |
| 2015/0308261 | A1 | 10/2015 | Zuo et al. | |
| 2015/0308264 | A1 | 10/2015 | Zuo et al. | |
| 2016/0061743 | A1 | 3/2016 | Wang et al. | |
| 2016/0130940 | A1 | 5/2016 | Hsu et al. | |
| 2016/0208600 | A1 | 7/2016 | Gisolf | |

* cited by examiner

APPLYING SHRINKAGE FACTOR TO REAL-TIME OBM FILTRATE CONTAMINATION MONITORING

CROSS-REFERENCE TO RELATED APPLICATIONS

This application claims the benefit of and priority to U.S. Provisional Application No. 62/0980,213, entitled "Applying Shrinkage Factor to Real-Time OBM Filtrate Contamination Monitoring," filed Dec. 30, 2014, the entire disclosure of which is hereby incorporated herein by reference.

BACKGROUND OF THE DISCLOSURE

Downhole fluid analysis (DFA) often involves oil-based mud (OBM) filtrate contamination monitoring (OCM). During OCM, it may be assumed that a fluid sampled from the subterranean formation is in a single phase. The phase may be liquid ("oil") or gas ("gas condensate"). The fluid may be theoretically flashed from downhole conditions to standard conditions (e.g., 14.7 psia and 60 degrees F.), resulting in some flashed liquid ("stock-tank oil" or "STO") and flashed gas. An associated shrinkage factor is defined as the ratio of the volume of STO at standard conditions to the volume of formation fluid at formation conditions.

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

The present disclosure introduces a method that includes disposing a downhole tool in a wellbore that extends into a subterranean formation. The downhole tool is in communication with surface equipment disposed at a wellsite surface from which the wellbore extends. At least one of the downhole tool and the surface equipment is operated to pump a volume V of contaminated fluid from the subterranean formation during an elapsed pumping time t while obtaining in-situ, real-time data associated with the contaminated fluid flowing through the downhole tool. The contaminated fluid comprises native formation fluid and oil-based mud (OBM) filtrate. At least one of the downhole tool and the surface equipment is also operated to determine a shrinkage factor b of the contaminated fluid based on the in-situ, real-time data, and fit the contaminated fluid shrinkage factor b relative to either the pumped volume V or the elapsed pumping time t to obtain a function relating the shrinkage factor b with either the pumped volume V or the elapsed pumping time t. At least one of the downhole tool and the surface equipment is also operated to determine a shrinkage factor $b_0$ of the native formation fluid based on the obtained function, determine a shrinkage factor $b_{OBM}$ of the OBM filtrate, and determine a volume percentage $v_{OBM}$ of the OBM filtrate within the contaminated fluid based on the determined shrinkage factor $b_0$ of the native formation fluid and the determined shrinkage factor $b_{OBM}$ of the OBM filtrate.

The present disclosure also introduces an apparatus that includes a downhole tool, operable within a wellbore extending from a wellsite surface into a subterranean formation, and surface equipment disposed at the wellsite surface and in communication with the downhole tool. The downhole tool and the surface equipment are individually or collectively operable to perform each of: pumping a volume V of contaminated fluid from the subterranean formation during an elapsed pumping time t while obtaining in-situ, real-time data associated with the contaminated fluid flowing through the downhole tool, the contaminated fluid comprising native formation fluid and oil-based mud (OBM) filtrate; determining a shrinkage factor b of the contaminated fluid based on the in-situ, real-time data; fitting the contaminated fluid shrinkage factor b relative to either the pumped volume V or the elapsed pumping time t to obtain a function relating the shrinkage factor b with either the pumped volume V or the elapsed pumping time t; determining a shrinkage factor $b_0$ of the native formation fluid based on the obtained function; determining a shrinkage factor $b_{OBM}$ of the OBM filtrate; and determining a volume percentage $v_{OBM}$ of the OBM filtrate within the contaminated fluid based on the determined shrinkage factor $b_0$ of the native formation fluid and the determined shrinkage factor $b_{OBM}$ of the OBM filtrate.

The present disclosure also introduces an apparatus that includes a downhole tool operable within a wellbore extending from a wellsite surface into a subterranean formation. The downhole tool includes a first non-transitory, computer-readable storage medium having a first program code stored thereon. The apparatus also includes surface equipment disposed at the wellsite surface and in communication with the downhole tool. The surface equipment comprises a second non-transitory, computer-readable storage medium having a second program code stored thereon. The first and second program codes individually or collectively include instructions individually or collectively executable by the downhole tool and the surface equipment for performance of each of: pumping a volume V of contaminated fluid from the subterranean formation during an elapsed pumping time t while obtaining in-situ, real-time data associated with the contaminated fluid flowing through the downhole tool, the contaminated fluid comprising native formation fluid and oil-based mud (OBM) filtrate; determining a shrinkage factor b of the contaminated fluid based on the in-situ, real-time data; fitting the contaminated fluid shrinkage factor b relative to either the pumped volume V or the elapsed pumping time t to obtain a function relating the shrinkage factor b with either the pumped volume V or the elapsed pumping time t; determining a shrinkage factor $b_0$ of the native formation fluid based on the obtained function; determining a shrinkage factor $b_{OBM}$ of the OBM filtrate; and determining a volume percentage $v_{OBM}$ of the OBM filtrate within the contaminated fluid based on the determined shrinkage factor $b_0$ of the native formation fluid and the determined shrinkage factor $b_{OBM}$ of the OBM filtrate.

These and additional aspects of the present disclosure are set forth in the description that follows, and/or may be learned by a person having ordinary skill in the art by reading the materials herein and/or practicing the principles described herein. At least some aspects of the present disclosure may be achieved via means recited in the attached claims.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
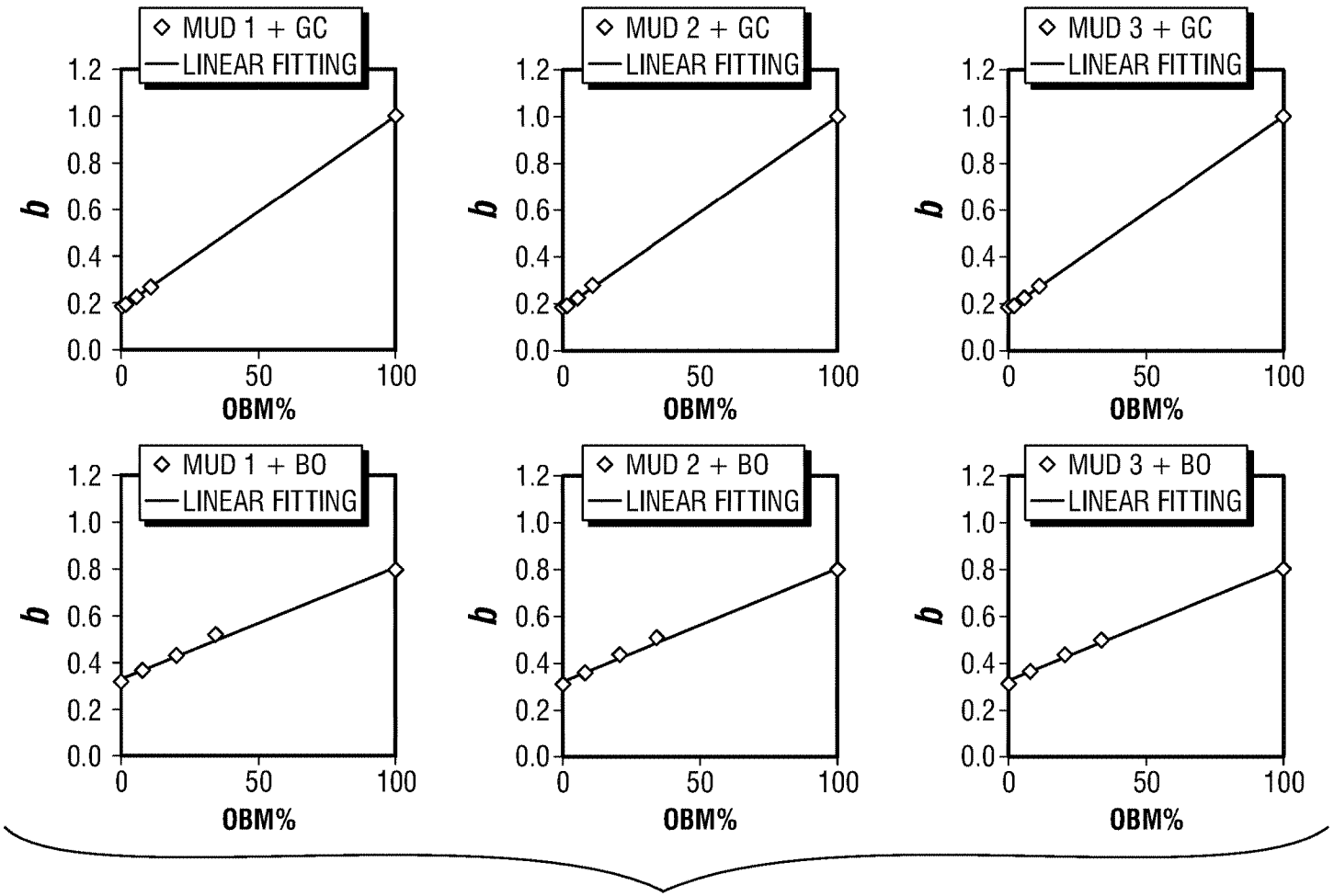
FIG. 1 is a series of charts pertaining to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

As described above, the single-stage flash shrinkage factor b (of contaminated fluid obtained by a downhole sampling tool) is defined as the ratio of the volume of STO at standard conditions to the volume of the native formation fluid at formation conditions, as set forth below in Equation (1).

$$b = \frac{V_{STO}}{V_{dh}} \tag{1}$$

where $V_{STO}$ is the volume of the STO and $V_{dh}$ is the volume of the contaminated fluid obtained by the downhole sampling tool, before flashing, at formation ("downhole") conditions. The shrinkage factor b of the contaminated fluid obtained by the downhole sampling tool is the reciprocal of the formation volume factor $B_o$, which may be determined utilizing Equation (1.1) set forth below.

$$B_o = \frac{\rho_{STO}}{\rho} + \frac{MW_g}{23.69}\frac{GOR}{\rho} \tag{1.1}$$

where:

GOR is the gas-oil-ratio (GOR) of the contaminated fluid obtained by the downhole sampling tool and determined based on in-situ, real-time optical density (OD) data obtained by the downhole sampling tool, for example;

$MW_g$ is the molecular weight of gas in the contaminated fluid obtained by the downhole sampling tool and determined based on the in-situ, real-time OD data obtained by the downhole sampling tool, for example;

ρ is the measured density of the contaminated fluid obtained by the downhole sampling tool and determined utilizing a density sensor and/or based on the in-situ, real-time OD data obtained by the downhole sampling tool, for example; and $\rho_{STO}$ is the density of the contaminated fluid at stock tank conditions and determined via known DFA techniques, such as may utilize artificial neural network (ANN) processing.

It can be assumed that the OBM filtrate remains with the STO after flashing. Thus, the volumes of the OBM filtrate and the native formation fluid at standard conditions may be expressed as set forth below in Equation (2).

$$V_{STO} = V_{OBM}^{std} + V_0^{std} \tag{2}$$

where $V_{OBM}^{std}$ is the volume of the OBM filtrate at standard conditions and $V_0^{std}$ is the volume of the native formation fluid at standard conditions.

Similarly, the volumes of the OBM filtrate and the native formation fluid at downhole conditions may be expressed as set forth below in Equation (3).

$$V_{dh} = V_{OBM}^{dg} + V_0^{dh} \tag{3}$$

where $V_{OBM}^{dh}$ is the volume of the OBM filtrate at downhole conditions and $V_0^{dh}$ is the volume of the native formation fluid at downhole conditions.

Equations (2) and (3) may be substituted into Equation (1) as set forth below in Equation (4).

$$b = \frac{V_{sto}}{V_{dh}} = \frac{V_{OBM}^{std} + V_0^{std}}{V_{dh}} = \frac{V_{OBM}^{std}}{V_{dh}} + \frac{V_0^{std}}{V_{dh}} = \frac{V_{OBM}^{dh}}{V_{dh}}\frac{V_{OBM}^{std}}{V_{OBM}^{dh}} + \frac{V_0^{dh}}{V_{dh}}\frac{V_0^{std}}{V_0^{dh}} = \frac{V_{OBM}^{dh}}{V_{dh}}\frac{V_{OBM}^{std}}{V_{OBM}^{dh}} + \frac{V_{dh} - V_{OBM}^{dh}}{V_{dh}}\frac{V_0^{std}}{V_0^{dh}} \tag{4}$$

According to the definition of the shrinkage factor b in Equation (1), the shrinkage factor of the OBM filtrate $b_{OBM}$ and the shrinkage factor of the native formation fluid $b_0$ may be expressed as set forth below in Equations (5) and (5.1).

$$b_{OBM} = \frac{V_{OBM}^{std}}{V_{OBM}^{dh}} \tag{5}$$

$$b_0 = \frac{V_0^{std}}{V_0^{dh}} \tag{5.1}$$

The volume percentage of the OBM filtrate contamination $V_{OBM}$ in the contaminated fluid obtained by the downhole sampling tool (that is, live fluid contamination at formation/downhole conditions) may be expressed as set forth below in Equation (6).

$$v_{OBM} = \frac{V_{OBM}^{dh}}{V_{dh}} \tag{6}$$

Substituting Equations (5), (5.1), and (6) into Equation (4), the mixing rule for the shrinkage factor b of the contaminated fluid obtained by the downhole sampling tool may be expressed as set forth below in Equation (7).

$$b=\nu_{OBM}b_{OBM}+(1-\nu_{OBM})b_0 \tag{7}$$

Therefore, the volume percentage of OBM filtrate $\nu_{OBM}$ in the contaminated fluid obtained by the downhole sampling tool may be estimated as set forth below in Equation (8).

$$\nu_{OBM}=\frac{b_0-b}{b_0-b_{OBM}} \tag{8}$$

However, the shrinkage factor for OBM filtrate $b_{OBM}$ may be assumed to be approximately equal to one. Thus, the volume percentage of OBM filtrate $\nu_{OBM}$ in the contaminated fluid obtained by the downhole sampling tool may be expressed as set forth below in Equation (9).

$$\nu_{OBM}=\frac{b_0-b}{b_0-1} \tag{9}$$

Therefore, the shrinkage factor may be utilized for downhole OCM in real-time. To confirm the linear mixing rule for the shrinkage factor given in Equation (9), experiments were conducted by mixing black oil (BO) and a gas condensate (GC) with three types of OBM filtrate, referred to herein and in FIG. 1 as Mud 1, Mud 2, and Mud 3, at different OBM contamination levels. As depicted in FIG. 1, the results confirm that the shrinkage factor b of the contaminated fluid obtained by the downhole sampling tool follows the linear mixing rule of Equation (9) over the entire OBM filtrate contamination range, from 0% OBM filtrate (i.e., 100% native formation fluid) to 100% OBM filtrate.

Figure 2:
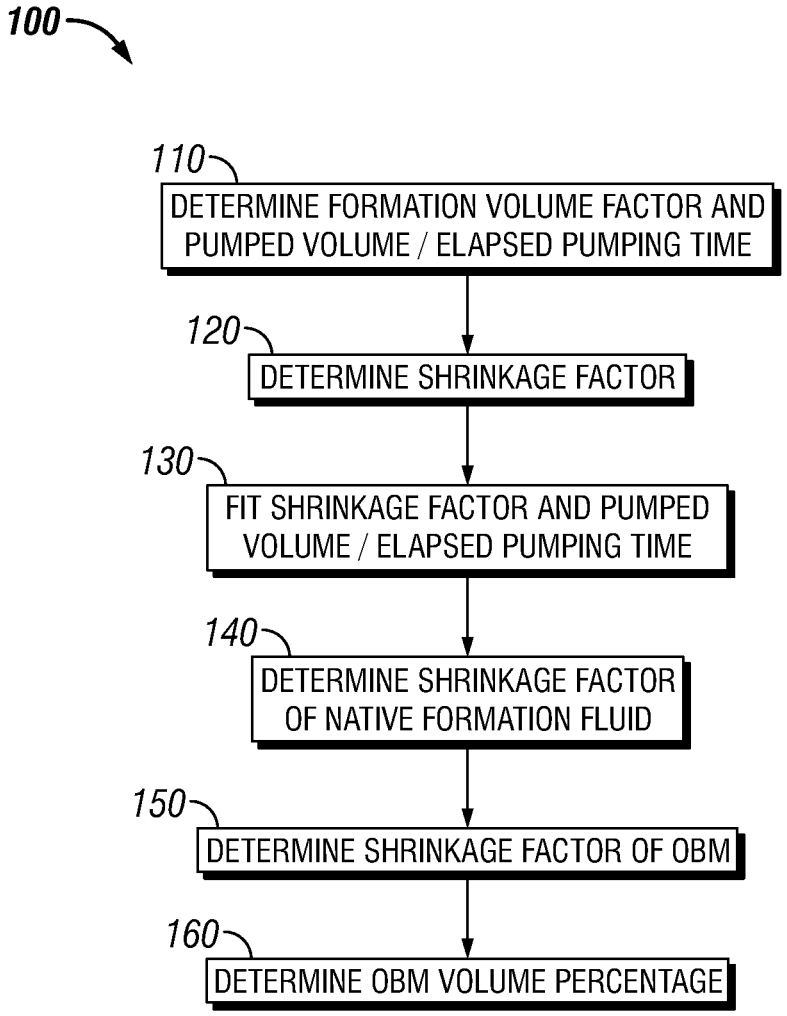
FIG. 2 is a flow-chart diagram of at least a portion of an example workflow according to one or more aspects of the present disclosure.

FIG. 2 is a flow-chart diagram of at least a portion of an example OCM workflow (100) utilizing the shrinkage factor according to one or more aspects of the present disclosure. The example OCM workflow (100) may include determining (110) the formation volume factor $B_o$ and either or both of the pumped volume V (of the contaminated fluid pumped by the downhole sampling tool) and the elapsed pumping time t. Determining (110) the formation volume factor $B_o$ may utilize Equation (1.1) set forth above, among other methods also within the scope of the present disclosure. The shrinkage factor b of the contaminated fluid obtained by the downhole sampling tool is then determined (120) based on the formation volume factor $B_o$ (as $b=1/B_o$). The shrinkage factor b data is then fit (130) relative to either the pumped volume V or the elapsed pumping time t to obtain a function relating the shrinkage factor b and either the pumped volume V or the elapsed pumping time t. Examples of such a fitting function include the power functions set forth below in Equations (10) and (10.1), although other fitting functions are also within the scope of the present disclosure.

$$b=b_0-\beta V^{-\gamma} \tag{10}$$

$$b=b_0-\beta t^{-\gamma} \tag{10.1}$$

where $b_0$ is the shrinkage factor of the native formation fluid and $\beta$ and $\gamma$ are adjustable parameters, each of which may be determined experimentally and/or via fitting real-time cleanup data, such as via utilization of Equation (11) set forth below.

$$\nu_{OBM}=\frac{OD_0-OD}{OD_0-OD_{OBM}}=\frac{\rho_0-\rho}{\rho_0-\rho_{OBM}}=b\frac{GOR_0-GOR}{GOR_0}=\frac{GOR_0-GOR}{GOR_0+(B_{o0}-1)GOR}=\frac{b-b_0}{b_{OBM}-b_0}=\beta V^{-\gamma} \tag{11}$$

where:

$B_{o0}$ is the formation volume factor of the native formation fluid;

OD is the measured optical density of the contaminated fluid obtained by the downhole sampling tool (referred to as apparent optical density);

$OD_0$ is the optical density of the native formation fluid;

$OD_{OBM}$ is the optical density of the OBM filtrate;

GOR is the gas-oil-ratio (GOR) of the contaminated fluid obtained by the downhole sampling tool (referred to as apparent GOR);

$GOR_0$ is the GOR of the native formation fluid;

$\rho$ is the measured density of the contaminated fluid obtained by the downhole sampling tool (referred to as apparent density);

$\rho_0$ is the density of the native formation fluid; and $\rho_{OBM}$ is the density of the OBM filtrate.

An equation similar to Equation (11) may be utilized to relate the above parameters to the elapsed pumping time t instead of the pumped volume V.

The example OCM workflow (100) may then include determining (140) the shrinkage factor of the native formation fluid $b_0$ by utilizing Equation (10) or (10.1) and extrapolating the pumped volume V or elapsed pumping time t to infinity. The shrinkage factor of the OBM filtrate $b_{OBM}$ may then be determined (150). For example, determining (150) the shrinkage factor of the OBM filtrate $b_{OBM}$ may include assuming that $b_{OBM}$ is approximately equal to one. However, the density of the OBM filtrate $\rho_{OBM}$ may be measured at surface, and the density of the OBM filtrate at downhole conditions $\rho_{OBM}^{dh}$ may also be obtained, in which case determining (150) the shrinkage factor of the OBM filtrate $b_{OBM}$ may include estimating the shrinkage factor of the OBM filtrate $b_{OBM}$ based on the OBM filtrate density $\rho_{OBM}$ measured at surface and the obtained OBM filtrate density at downhole conditions $\rho_{OBM}^{dh}$, such as by extrapolating a shrinkage-density crossplot to the $\rho_{OBM}$ point and reading the $b_{OBM}$. In either case, the OBM volume percentage $\nu_{OBM}$ may then be determined (160) in terms of Equation (8) or (9).

Figure 3:
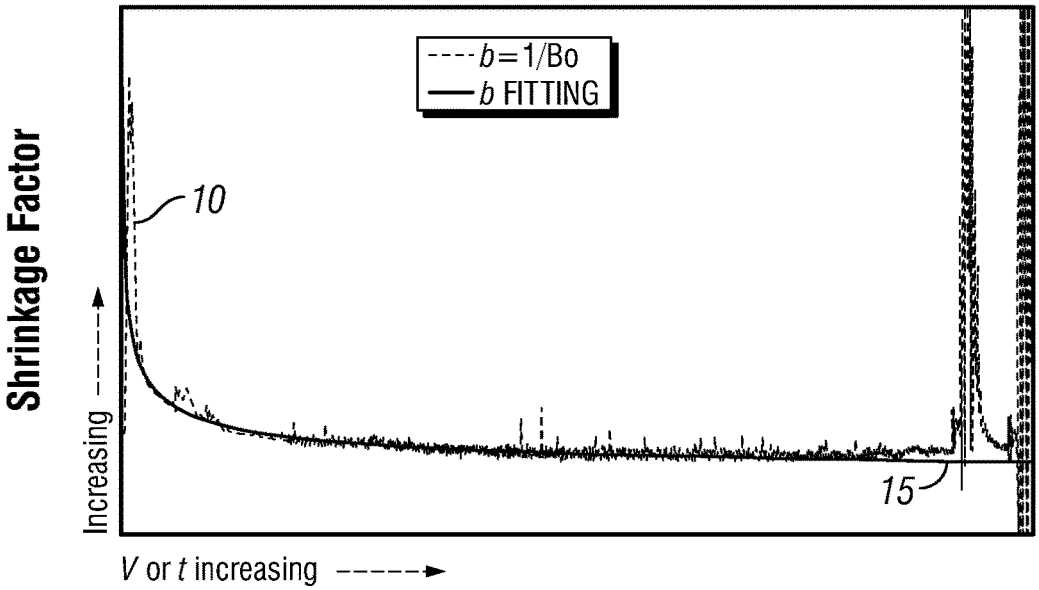
FIG. 3 is a graph depicting example data pertaining to one or more aspects of the present disclosure.

An example utilizing the OCM workflow (100) will now be described. FIG. 3 depicts shrinkage factor changes during an example cleanup operation utilizing a downhole sampling tool having a single probe. The exponent $\gamma$ in the power function of Equation (10) corresponding to the example probe utilized in association with the data in FIG. 3 was determined to be $-5/12$ (although other values are also within the scope of the present disclosure, corresponding to other types of sampling probes and/or downhole sampling tools). Therefore, the dataset of the shrinkage factor b versus the pumped volume V of the contaminated fluid obtained by the downhole sampling tool (dashed line 10) can be fitted by, for example, the power function of Equation (10). The fitting results (solid line 15) are also depicted in FIG. 3, resulting in a fitted power function of $b=0.7317+1.1502V^{-5/12}$. The shrinkage factor of the native formation fluid $b_0$ was determined to be 0.7317 by extrapolating the pumped volume V to infinity. As described above, this approach may utilize the elapsed pumping time t instead of the pumped volume V.

Figure 4:
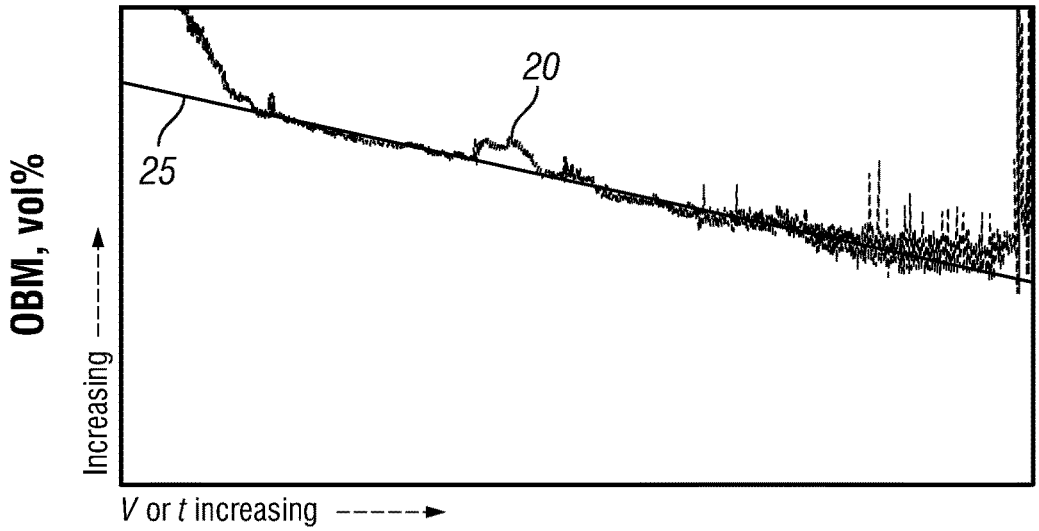
FIG. 4 is a graph depicting example data pertaining to one or more aspects of the present disclosure.

In this example, it is assumed that the shrinkage factor of the OBM filtrate $b_{OBM}$ is approximately equal to one. Thus, the OBM volume percentage $v_{OBM}$ can be calculated during the cleanup operation in terms of the mixing rule of Equation (9). The results are illustrated in FIG. 4, in which the dashed line 20 is the shrinkage factor data and the solid line 25 is the linear fitting. The estimated OBM volume percentage $v_{OBM}$ based on the shrinkage factor is about 10%, which substantially conforms to the laboratory-obtained percentage of about 11%.

Figure 5:
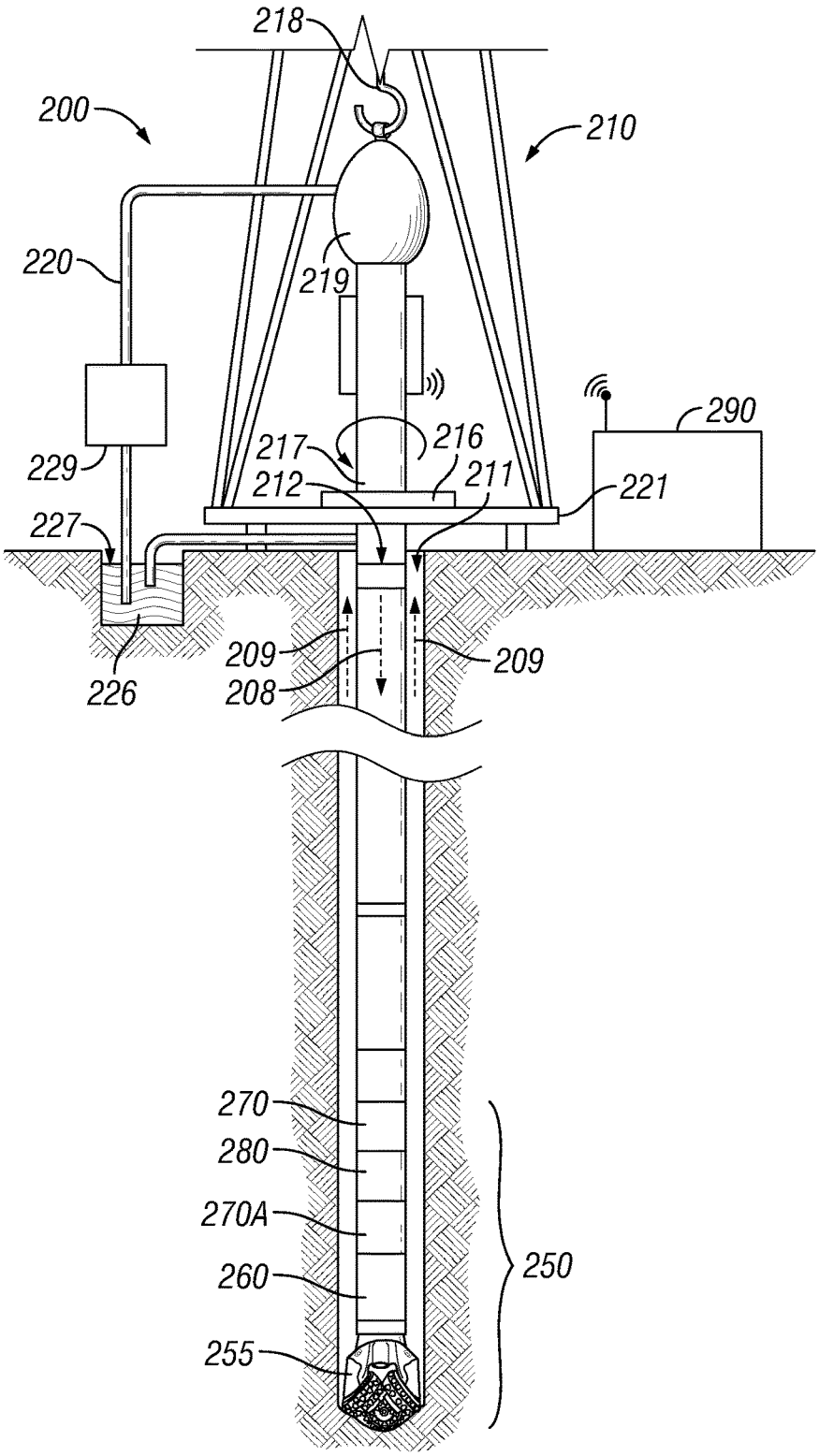
FIG. 5 is a schematic view of at least a portion of apparatus according to one or more aspects of the present disclosure.

FIG. 5 is a schematic view of an example wellsite system 200 in which one or more aspects of OCM disclosed herein may be employed. The wellsite 200 may be onshore or offshore. In the example system shown in FIG. 5, a wellbore 211 is formed in subterranean formations by rotary drilling. However, other example systems within the scope of the present disclosure may also or instead utilize directional drilling.

As shown in FIG. 5, a drillstring 212 suspended within the wellbore 211 comprises a bottom hole assembly (BHA) 250 that includes or is coupled with a drill bit 255 at its lower end. The surface system includes a platform and derrick assembly 210 positioned over the wellbore 211. The assembly 210 may comprise a rotary table 216, a kelly 217, a hook 218, and a rotary swivel 219. The drill string 212 may be suspended from a lifting gear (not shown) via the hook 218, with the lifting gear being coupled to a mast (not shown) rising above the surface. An example lifting gear includes a crown block whose axis is affixed to the top of the mast, a vertically traveling block to which the hook 218 is attached, and a cable passing through the crown block and the vertically traveling block. In such an example, one end of the cable is affixed to an anchor point, whereas the other end is affixed to a winch to raise and lower the hook 218 and the drillstring 212 coupled thereto. The drillstring 212 comprises one or more types of drill pipes threadedly attached one to another, perhaps including wired drilled pipe.

The drillstring 212 may be raised and lowered by turning the lifting gear with the winch, which may sometimes include temporarily unhooking the drillstring 212 from the lifting gear. In such scenarios, the drillstring 212 may be supported by blocking it with wedges in a conical recess of the rotary table 216, which is mounted on a platform 221 through which the drillstring 212 passes.

The drillstring 212 may be rotated by the rotary table 216, which engages the kelly 217 at the upper end of the drillstring 212. The drillstring 212 is suspended from the hook 218, attached to a traveling block (not shown), through the kelly 217 and the rotary swivel 219, which permits rotation of the drillstring 212 relative to the hook 218. Other example wellsite systems within the scope of the present disclosure may utilize a top drive system to suspend and rotate the drillstring 212, whether in addition to or instead of the illustrated rotary table system.

The surface system may further include drilling fluid or mud 226 stored in a pit 227 formed at the wellsite. As described above, the drilling fluid 226 may comprise OBM. A pump 229 delivers the drilling fluid 226 to the interior of the drillstring 212 via a hose or other conduit 220 coupled to a port in the swivel 219, causing the drilling fluid to flow downward through the drillstring 212 as indicated by the directional arrow 208. The drilling fluid exits the drillstring 212 via ports in the drill bit 255, and then circulates upward through the annulus region between the outside of the drillstring 212 and the wall of the wellbore 211, as indicated by the directional arrows 209. In this manner, the drilling fluid 226 lubricates the drill bit 255 and carries formation cuttings up to the surface as it is returned to the pit 227 for recirculation.

The BHA 250 may comprise one or more specially made drill collars near the drill bit 255. Each such drill collar may comprise one or more logging devices, thereby permitting downhole drilling conditions and/or various characteristic properties of the geological formation (e.g., such as layers of rock or other material) intersected by the wellbore 211 to be measured as the wellbore 211 is deepened. For example, the BHA 250 may comprise a logging-while-drilling (LWD) module 270, a measurement-while-drilling (MWD) module 280, a rotary-steerable system and motor 260, and/or the drill bit 255. Of course, other BHA components, modules, and/or tools are also within the scope of the present disclosure.

The LWD module 270 may be housed in a drill collar and may comprise one or more logging tools. More than one LWD and/or MWD module may be employed, e.g., as represented at 270A. References herein to a module at the position of 270 may mean a module at the position of 270A as well. The LWD module 270 may comprise capabilities for measuring, processing, and storing information, as well as for communicating with the surface equipment.

The MWD module 280 may also be housed in a drill collar and may comprise one or more devices for measuring characteristics of the drillstring 212 and/or drill bit 255. The MWD module 280 may further comprise an apparatus (not shown) for generating electrical power to be utilized by the downhole system. This may include a mud turbine generator powered by the flow of the drilling fluid 226. However, other power and/or battery systems may also or instead be employed. In the example shown in FIG. 5, the MWD module 280 comprises one or more of the following types of measuring devices: a weight-on-bit measuring device, a torque measuring device, a vibration measuring device, a shock measuring device, a stick slip measuring device, a direction measuring device, and an inclination measuring device, among others within the scope of the present disclosure. The wellsite system 200 also comprises a logging and control unit and/or other surface equipment 290 communicably coupled to the LWD modules 270/270A and/or the MWD module 280.

At least one of the LWD modules 270/270A and/or the MWD module 280 comprises a downhole tool (such as the downhole sampling tool described above with respect to Equations (1)-(11)) operable to obtain downhole a sample of fluid from the subterranean formation, obtain in-situ, real-time data associated with the sampled fluid (such as may comprise one or more of the parameters described above with respect to one or more of Equations (1)-(11)), and perform DFA of the sampled fluid. Such DFA may be utilized for OCM according to one or more aspects described above. The downhole tool may then report the resulting data to the surface equipment 290.

The operational elements of the BHA 250 may be controlled by one or more electrical control systems within the BHA 250 and/or the surface equipment 290. For example, such control system(s) may include processor capability for characterization of formation fluids in one or more components of the BHA 250 according to one or more aspects of the present disclosure. Methods within the scope of the present disclosure may be embodied in one or more computer programs that run in one or more processors located, for example, in one or more components of the BHA 250 and/or the surface equipment 290. Such programs may utilize data received from one or more components of the BHA 250, for example, via mud-pulse telemetry and/or other telemetry means, and may be operable to transmit control signals to operative elements of the BHA 250. The programs may be stored on a suitable computer-usable storage medium associated with one or more processors of the BHA 250 and/or surface equipment 290, or may be stored on an external computer-usable storage medium that is electronically coupled to such processor(s). The storage medium may be one or more known or future-developed storage media, such as a magnetic disk, an optically readable disk, flash memory, or a readable device of another kind, including a remote storage device coupled over a telemetry link, among others.

Figure 6:
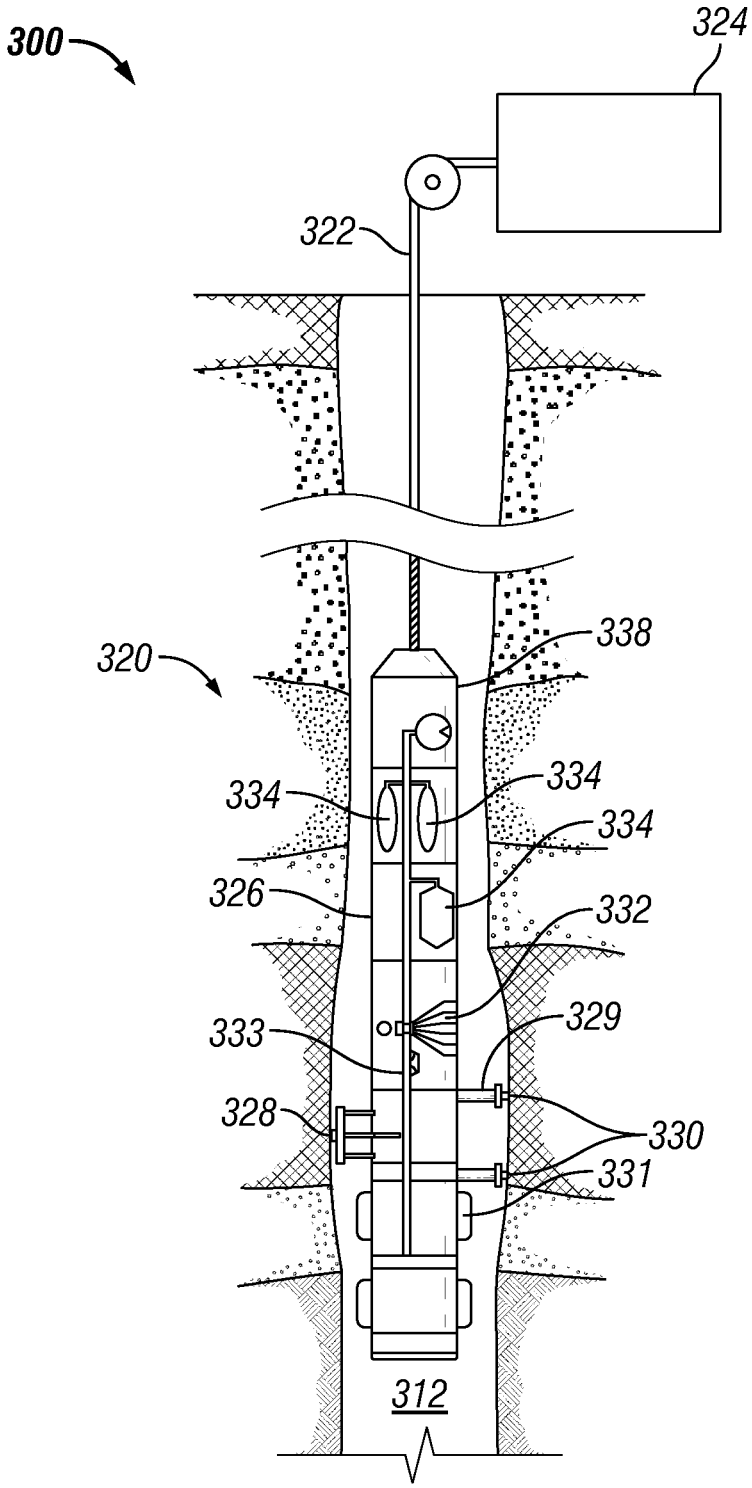
FIG. 6 is a schematic view of at least a portion of apparatus according to one or more aspects of the present disclosure.

FIG. 6 is a schematic view of another example operating environment for implementing one or more aspects of the present disclosure, wherein a downhole tool 320 (such as the downhole sampling tool described above with respect to Equations (1)-(11)) is suspended at the end of a wireline 322 at a wellsite having a wellbore 312. The downhole tool 320 and wireline 322 are structured and arranged with respect to a service vehicle (not shown) at the wellsite. As with the system 200 shown in FIG. 5, the example system 300 of FIG. 6 may be utilized for downhole sampling and analysis of formation fluids. The system 300 includes the downhole tool 320, which may be used for testing earth formations and analyzing fluids obtained therefrom, and also includes associated telemetry and control devices and electronics, as well as surface control and communication equipment 324. The downhole tool 320 is suspended in the wellbore 312 from the lower end of the wireline 322, which may be a multi-conductor logging cable spooled on a winch (not shown). The wireline 322 is electrically coupled to the surface equipment 324, which may have one or more aspects in common with the surface equipment 290 shown in FIG. 5.

The downhole tool 320 comprises an elongated body 326 encasing a variety of electronic components and modules, which are schematically represented in FIG. 6, for providing functionality to the downhole tool 320. A selectively extendible fluid admitting assembly 328 and one or more selectively extendible anchoring members 330 are respectively arranged on opposite sides of the elongated body 326. The fluid admitting assembly 328 is operable to selectively seal off or isolate selected portions of the wellbore wall 312 such that pressure or fluid communication with the adjacent formation may be established. The fluid admitting assembly 328 may be or comprise a single probe module 329 and/or a packer module 331.

One or more fluid sampling and analysis modules 332 are provided in the tool body 326. Fluids obtained from the formation flow through a flowline 333, via the fluid analysis module or modules 332, and then may be discharged through a port of a pumpout module 338. Alternatively, formation fluids in the flowline 333 may be directed to one or more fluid collecting chambers 334 for receiving and retaining the fluids obtained from the formation for transportation to the surface.

The fluid admitting assemblies, one or more fluid analysis modules, the flow path, the collecting chambers, and/or other operational elements of the downhole tool 320 may be controlled by one or more electrical control systems within the downhole tool 320 and/or the surface equipment 324. For example, such control system(s) may include processor capability for characterization of formation fluids in the downhole tool 320 according to one or more aspects of the present disclosure. Methods within the scope of the present disclosure may be embodied in one or more computer programs that run in one or more processors located, for example, in the downhole tool 320 and/or the surface equipment 324. Such programs may utilize data received from, for example, the fluid sampling and analysis module 332, via the wireline cable 322, and may be operable to transmit control signals to operative elements of the downhole tool 320. The programs may be stored on a suitable computer-usable storage medium associated with the one or more processors of the downhole tool 320 and/or surface equipment 324, or may be stored on an external computer-usable storage medium that is electronically coupled to such processor(s). The storage medium may be one or more known or future-developed storage media, such as a magnetic disk, an optically readable disk, flash memory, or a readable device of another kind, including a remote storage device coupled over a switched telecommunication link, among others.

FIGS. 5 and 6 illustrate mere examples of environments in which one or more aspects of the present disclosure may be implemented. For example, in addition to the drillstring environment of FIG. 5 and the wireline environment of FIG. 6, one or more aspects of the present disclosure may be applicable or readily adaptable for implementation in other environments utilizing other means of conveyance within the wellbore, including coiled tubing, TLC, slickline, and others.

Figure 7:
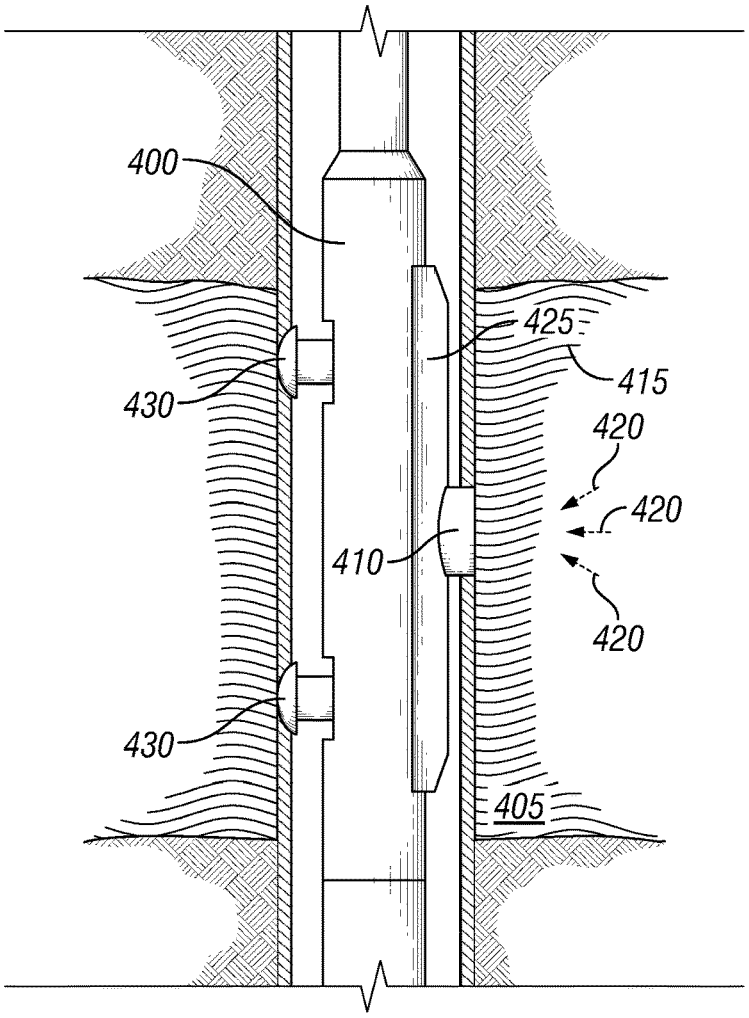
FIG. 7 is a schematic view of at least a portion of apparatus according to one or more aspects of the present disclosure.

An example downhole tool or module 400 that may be utilized in the example systems 200 and 300 of FIGS. 5 and 6, respectively, such as to obtain a sample of fluid from a subterranean formation 405 and perform DFA for OCM of the obtained fluid sample, is schematically shown in FIG. 7. The tool 400 is provided with a probe 410 for establishing fluid communication with the formation 405 and drawing formation fluid 415 into the tool, as indicated by arrows 420. The probe 410 may be positioned in a stabilizer blade 425 of the tool 400, and may be extended therefrom to engage the wellbore wall. The stabilizer blade 425 may be or comprise one or more blades that are in contact with the wellbore wall. The tool 400 may comprise backup pistons 430 operable to press the tool 400 and, thus, the probe 410 into contact with the wellbore wall. Fluid drawn into the tool 400 via the probe 410 may be measured to determine the various properties described above, for example. The tool 400 may also comprise one or more chambers and/or other devices for collecting fluid samples for retrieval at the surface.

Figure 8:
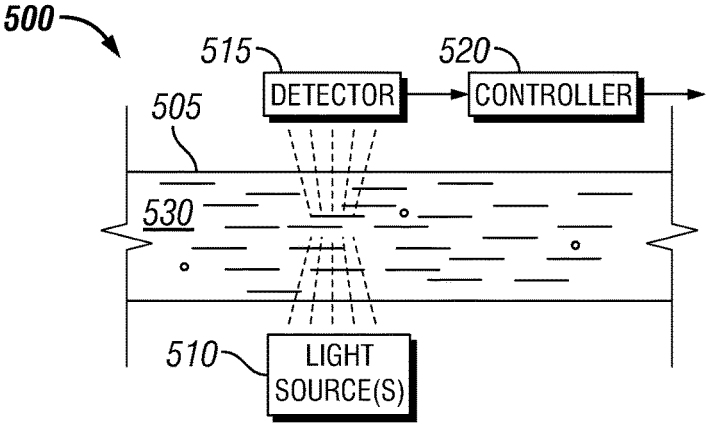
FIG. 8 is a schematic view of at least a portion of apparatus according to one or more aspects of the present disclosure.

An example downhole fluid analyzer 500 that may be used to implement DFA in the example downhole tool 400 shown in FIG. 7 is schematically shown in FIG. 8. The downhole fluid analyzer 500 may be part of or otherwise work in conjunction with a downhole tool operable to obtain a sample of fluid 530 from the formation, such as the downhole tools/modules shown in FIGS. 5-7. For example, a flowline 505 of the downhole tool may extend past an optical spectrometer having one or more light sources 510 and a detector 515. The detector 515 senses light that has transmitted through the formation fluid 530 in the flowline 505, resulting in optical spectra that may be utilized according to one or more aspects of the present disclosure. For example, a controller 520 associated with the downhole fluid analyzer 500 and/or the downhole tool may utilize measured optical spectra to perform OCM of the formation fluid 530 in the flowline 505 according to one or more aspects of DFA and/or OCM introduced herein. The resulting information may then be reported via telemetry to surface equipment, such as the surface equipment 290 shown in FIG. 5 and/or the surface equipment 324 shown in FIG. 6. Moreover, the downhole fluid analyzer 500 may perform the bulk of its processing downhole and report just a relatively small amount of measurement data up to the surface. Thus, the downhole fluid analyzer 500 may provide high-speed (e.g., real-time) DFA measurements using a relatively low bandwidth telemetry communication link. As such, the telemetry communication link may be implemented by most types of communication links, unlike conventional DFA techniques that utilize high-speed communication links to transmit high-bandwidth signals to the surface.

Figure 9:
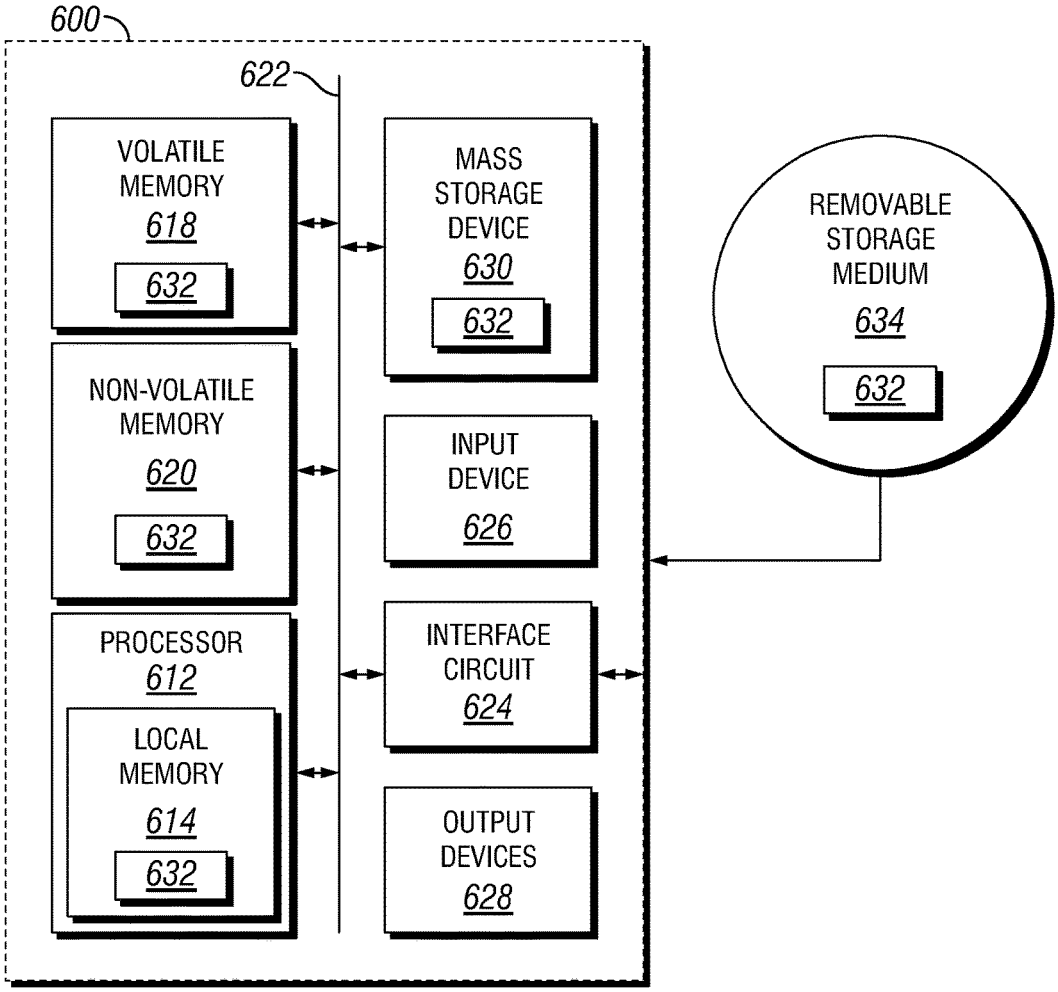
FIG. 9 is a schematic view of at least a portion of apparatus according to one or more aspects of the present disclosure.

FIG. 9 is a schematic view of at least a portion of apparatus according to one or more aspects of the present disclosure. The apparatus is or comprises a processing system 600 that may execute example machine-readable instructions to implement at least a portion of one or more of the methods and/or processes described herein, and/or to implement a portion of one or more of the example downhole tools described herein. The processing system 600 may be or comprise, for example, one or more processors, controllers, special-purpose computing devices, servers, personal computers, personal digital assistant ("PDA") devices, smartphones, internet appliances, and/or other types of computing devices. Moreover, while it is possible that the entirety of the processing system 600 shown in FIG. 9 is implemented within downhole apparatus, such as the LWD module 270/270A and/or MWD module 280 shown in FIG. 5, the fluid sampling and analysis module 332 shown in FIG. 6, the controller 520 shown in FIG. 8, other components shown in one or more of FIGS. 5-8, and/or other downhole apparatus, it is also contemplated that one or more components or functions of the processing system 600 may be implemented in wellsite surface equipment, perhaps including the surface equipment 290 shown in FIG. 5, the surface equipment 324 shown in FIG. 6, and/or other surface equipment.

The processing system 600 may comprise a processor 612 such as, for example, a general-purpose programmable processor. The processor 612 may comprise a local memory 614, and may execute coded instructions 632 present in the local memory 614 and/or another memory device. The processor 612 may execute, among other things, machine-readable instructions or programs to implement the methods and/or processes described herein. The programs stored in the local memory 614 may include program instructions or computer program code that, when executed by an associated processor, may permit surface equipment and/or downhole controller and/or control system to perform tasks as described herein. The processor 612 may be, comprise, or be implemented by one or more processors of various types suitable to the local application environment, and may include one or more of general-purpose computers, special-purpose computers, microprocessors, digital signal processors ("DSPs"), field-programmable gate arrays ("FPGAs"), application-specific integrated circuits ("ASICs"), and processors based on a multi-core processor architecture, as non-limiting examples. Of course, other processors from other families are also appropriate.

The processor 612 may be in communication with a main memory, such as may include a volatile memory 618 and a non-volatile memory 620, perhaps via a bus 622 and/or other communication means. The volatile memory 618 may be, comprise, or be implemented by random access memory (RAM), static random access memory (SRAM), synchronous dynamic random access memory (SDRAM), dynamic random access memory (DRAM), RAMBUS dynamic random access memory (RDRAM) and/or other types of random access memory devices. The non-volatile memory 620 may be, comprise, or be implemented by read-only memory, flash memory and/or other types of memory devices. One or more memory controllers (not shown) may control access to the volatile memory 618 and/or the non-volatile memory 620.

The processing system 600 may also comprise an interface circuit 624. The interface circuit 624 may be, comprise, or be implemented by various types of standard interfaces, such as an Ethernet interface, a universal serial bus (USB), a third generation input/output (3GIO) interface, a wireless interface, and/or a cellular interface, among others. The interface circuit 624 may also comprise a graphics driver card. The interface circuit 624 may also comprise a communication device such as a modem or network interface card to facilitate exchange of data with external computing devices via a network (e.g., Ethernet connection, digital subscriber line ("DSL"), telephone line, coaxial cable, cellular telephone system, satellite, etc.).

One or more input devices 626 may be connected to the interface circuit 624. The input device(s) 626 may permit a user to enter data and commands into the processor 612. The input device(s) 626 may be, comprise, or be implemented by, for example, a keyboard, a mouse, a touchscreen, a track-pad, a trackball, an isopoint, and/or a voice recognition system, among others.

One or more output devices 628 may also be connected to the interface circuit 624. The output devices 628 may be, comprise, or be implemented by, for example, display devices (e.g., a liquid crystal display or cathode ray tube display (CRT), among others), printers, and/or speakers, among others.

The processing system 600 may also comprise one or more mass storage devices 630 for storing machine-readable instructions and data. Examples of such mass storage devices 630 include floppy disk drives, hard drive disks, compact disk (CD) drives, and digital versatile disk (DVD) drives, among others. The coded instructions 632 may be stored in the mass storage device 630, the volatile memory 618, the non-volatile memory 620, the local memory 614, and/or on a removable storage medium 634, such as a CD or DVD. Thus, the modules and/or other components of the processing system 600 may be implemented in accordance with hardware (embodied in one or more chips including an integrated circuit such as an application specific integrated circuit), or may be implemented as software or firmware for execution by a processor. In particular, in the case of firmware or software, the embodiment can be provided as a computer program product including a computer readable medium or storage structure embodying computer program code (i.e., software or firmware) thereon for execution by the processor.

In view of the entirety of the present disclosure, including the claims and the figures, a person having ordinary skill in the art will readily recognize that the present disclosure introduces a method comprising: disposing a downhole tool in a wellbore that extends into a subterranean formation, wherein the downhole tool is in communication with surface equipment disposed at a wellsite surface from which the wellbore extends; and operating at least one of the downhole tool and the surface equipment to: pump a volume V of contaminated fluid from the subterranean formation during an elapsed pumping time t while obtaining in-situ, real-time data associated with the contaminated fluid flowing through the downhole tool, wherein the contaminated fluid comprises native formation fluid and oil-based mud (OBM) filtrate; determine a shrinkage factor b of the contaminated fluid based on the in-situ, real-time data; fit the contaminated fluid shrinkage factor b relative to either the pumped volume V or the elapsed pumping time t to obtain a function relating the shrinkage factor b with either the pumped volume V or the elapsed pumping time t; determine a shrinkage factor $b_0$ of the native formation fluid based on the obtained function; determine a shrinkage factor $b_{OBM}$ of the OBM filtrate; and determine a volume percentage $v_{OBM}$ of the OBM filtrate within the contaminated fluid based on the determined shrinkage factor $b_0$ of the native formation fluid and the determined shrinkage factor $b_{OBM}$ of the OBM filtrate.

The method may further comprise operating at least one of the downhole tool and the surface equipment to determine a formation volume factor $B_o$ based on the in-situ, real-time data. In such implementations, among others within the scope of the present disclosure, the shrinkage factor b of the contaminated fluid may be determined based on the determined formation volume factor $B_o$, and the formation volume factor $B_o$ may be determined based on: a gas-oil-ratio (GOR) of the contaminated fluid determined based on the in-situ, real-time data; a molecular weight of gas in the contaminated fluid determined based on the in-situ, real-time data; a density of the contaminated fluid determined based on the in-situ, real-time data; and a density of the contaminated fluid at stock tank conditions determined based on the in-situ, real-time data.

The function may be a power function.

The function may be $b=b_0-\beta V^{-\gamma}$, where, for fitting purposes, $b_0$, $\beta$, and $\gamma$ are adjustable parameters determined via fitting the obtained in-situ, real-time data. For fitting purposes, $b_0$, $\beta$, and $\gamma$ may be determined via utilization of at least a portion of:

$$v_{OBM} = \frac{OD_0 - OD}{OD_0 - OD_{OBM}} = \frac{\rho_0 - \rho}{\rho_0 - \rho_{OBM}} = b\frac{GOR_0 - GOR}{GOR_0} = \frac{GOR_0 - GOR}{GOR_0 + (B_{o0} - 1)GOR} = \frac{b - b_0}{b_{OBM} - b_0} = \beta V^{-\gamma}$$

where:

- $B_{o0}$ is formation volume factor of the native formation fluid;
- $b_{OBM}$ is shrinkage factor of the OBM filtrate;
- OD is optical density of the contaminated fluid, which is included in the obtained in-situ, real-time data;
- $OD_0$ is optical density of the native formation fluid;
- $OD_{OBM}$ is optical density of the OBM filtrate;
- GOR is gas-oil-ratio (GOR) of the contaminated fluid;
- $GOR_0$ is GOR of the native formation fluid;
- $\rho$ is density of the contaminated fluid;
- $\rho_0$ is density of the native formation fluid; and
- $\rho_{OBM}$ is density of the OBM filtrate.

The function may be $b=b_0-\beta t^{-\gamma}$, where, for fitting purposes, $b_0$, $\beta$, and $\gamma$ are adjustable parameters determined via fitting the obtained in-situ, real-time data.

The shrinkage factor $b_0$ of the native formation fluid may be determined utilizing the obtained function by extrapolating the pumped volume V or elapsed pumping time t to infinity.

The shrinkage factor $b_{OBM}$ of the OBM filtrate may be determined by assuming that $b_{OBM}$ is approximately equal to one.

The method may further comprise measuring density of the OBM filtrate at the wellsite surface. In such implementations, among others within the scope of the present disclosure, obtaining the in-situ, real-time data may include obtaining density of the OBM filtrate at downhole conditions, and the shrinkage factor $b_{OBM}$ of the OBM filtrate may be determined by estimating $b_{OBM}$ based on the OBM filtrate density measured at the wellsite surface and the obtained density of the OBM filtrate at downhole conditions.

The volume percentage $v_{OBM}$ of the OBM filtrate may be determined utilizing:

$$v_{OBM} = \frac{b_0 - b}{b_0 - b_{OBM}}.$$

The volume percentage $v_{OBM}$ of the OBM filtrate may be determined utilizing:

$$v_{OBM} = \frac{b_0 - b}{b_0 - 1}.$$

The present disclosure also introduces an apparatus comprising: a downhole tool operable within a wellbore extending from a wellsite surface into a subterranean formation; and surface equipment disposed at the wellsite surface and in communication with the downhole tool, wherein the downhole tool and the surface equipment are individually or collectively operable to perform each of: pumping a volume V of contaminated fluid from the subterranean formation during an elapsed pumping time t while obtaining in-situ, real-time data associated with the contaminated fluid flowing through the downhole tool, wherein the contaminated fluid comprises native formation fluid and oil-based mud (OBM) filtrate; determining a shrinkage factor b of the contaminated fluid based on the in-situ, real-time data; fitting the contaminated fluid shrinkage factor b relative to either the pumped volume V or the elapsed pumping time t to obtain a function relating the shrinkage factor b with either the pumped volume V or the elapsed pumping time t; determining a shrinkage factor $b_0$ of the native formation fluid based on the obtained function; determining a shrinkage factor $b_{OBM}$ of the OBM filtrate; and determining a volume percentage $v_{OBM}$ of the OBM filtrate within the contaminated fluid based on the determined shrinkage factor $b_0$ of the native formation fluid and the determined shrinkage factor $b_{OBM}$ of the OBM filtrate.

The downhole tool and the surface equipment may also be individually or collectively operable to determine a formation volume factor $B_o$ based on the in-situ, real-time data. In such implementations, among others within the scope of the present disclosure, the shrinkage factor b of the contaminated fluid may be determined based on the determined formation volume factor $B_o$, and the formation volume factor $B_o$ may be determined based on: a gas-oil-ratio (GOR) of the contaminated fluid determined based on the in-situ, real-time data; a molecular weight of gas in the contaminated fluid determined based on the in-situ, real-time data; a density of the contaminated fluid determined based on the in-situ, real-time data; and a density of the contaminated fluid at stock tank conditions determined based on the in-situ, real-time data.

The function may be a power function.

The function may be $b=b_0-\beta V^{-\gamma}$, where, for fitting purposes, $b_0$, $\beta$, and $\gamma$ are adjustable parameters determined via fitting the obtained in-situ, real-time data.

The function may be $b=b_0-\beta t^{-\gamma}$, where, for fitting purposes, $b_0$, $\beta$, and $\gamma$ are adjustable parameters determined via fitting the obtained in-situ, real-time data.

The shrinkage factor $b_0$ of the native formation fluid may be determined utilizing the obtained function by extrapolating the pumped volume V or elapsed pumping time t to infinity.

The shrinkage factor $b_{OBM}$ of the OBM filtrate may be determined by assuming that $b_{OBM}$ is approximately equal to one.

The downhole tool and the surface equipment may be individually or collectively operable to measure density of the OBM filtrate at the wellsite surface. In such implementations, among others within the scope of the present disclosure, obtaining the in-situ, real-time data may include obtaining density of the OBM filtrate at downhole conditions, and the shrinkage factor $b_{OBM}$ of the OBM filtrate may be determined by estimating $b_{OBM}$ based on the OBM filtrate density measured at the wellsite surface and the obtained density of the OBM filtrate at downhole conditions.

The volume percentage $v_{OBM}$ of the OBM filtrate may be determined utilizing:

$$v_{OBM} = \frac{b_0 - b}{b_0 - b_{OBM}}.$$

The volume percentage $v_{OBM}$ of the OBM filtrate may be determined utilizing:

$$v_{OBM} = \frac{b_0 - b}{b_0 - 1}.$$

The present disclosure also introduces an apparatus comprising: a downhole tool operable within a wellbore extending from a wellsite surface into a subterranean formation, wherein the downhole tool comprises a first non-transitory, computer-readable storage medium having a first program code stored thereon; and surface equipment disposed at the wellsite surface and in communication with the downhole tool, wherein the surface equipment comprises a second non-transitory, computer-readable storage medium having a second program code stored thereon; wherein the first and second program codes individually or collectively include instructions individually or collectively executable by the downhole tool and the surface equipment for performance of each of: pumping a volume V of contaminated fluid from the subterranean formation during an elapsed pumping time t while obtaining in-situ, real-time data associated with the contaminated fluid flowing through the downhole tool, wherein the contaminated fluid comprises native formation fluid and oil-based mud (OBM) filtrate; determining a shrinkage factor b of the contaminated fluid based on the in-situ; fitting the contaminated fluid shrinkage factor b relative to either the pumped volume V or the elapsed pumping time t to obtain a function relating the shrinkage factor b with either the pumped volume V or the elapsed pumping time t; determining a shrinkage factor $b_0$ of the native formation fluid based on the obtained function; determining a shrinkage factor $b_{OBM}$ of the OBM filtrate; and determining a volume percentage $v_{OBM}$ of the OBM filtrate within the contaminated fluid based on the determined shrinkage factor $b_0$ of the native formation fluid and the determined shrinkage factor $b_{OBM}$ of the OBM filtrate.

The first and second program codes may also individually or collectively include instructions individually or collectively executable by the downhole tool and the surface equipment for performance of determining a formation volume factor $B_o$ based on the in-situ, real-time data. In such implementations, among others within the scope of the present disclosure, the shrinkage factor b of the contaminated fluid may be determined based on the determined formation volume factor $B_o$, and the formation volume factor $B_o$ may be determined based on: a gas-oil-ratio (GOR) of the contaminated fluid determined based on the in-situ, real-time data; a molecular weight of gas in the contaminated fluid determined based on the in-situ, real-time data; a density of the contaminated fluid determined based on the in-situ, real-time data; and a density of the contaminated fluid at stock tank conditions determined based on the in-situ, real-time data.

The function may be a power function.

The shrinkage factor $b_0$ of the native formation fluid may be determined utilizing the obtained function by extrapolating the pumped volume V or elapsed pumping time t to infinity.

The shrinkage factor $b_{OBM}$ of the OBM filtrate may be determined by assuming that $b_{OBM}$ is approximately equal to one.

The volume percentage $v_{OBM}$ of the OBM filtrate may be determined utilizing:

$$v_{OBM} = \frac{b_0 - b}{b_0 - 1}.$$

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same functions and/or achieving the same benefits of the embodiments introduced herein. A person having ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. § 1.72(b) to permit the reader to quickly ascertain the nature of the technical disclosure. It is submitted with the understanding that it will not be used to interpret or limit the scope or meaning of the claims.

What is claimed is:

1. A method, comprising:

disposing a downhole tool in a wellbore that extends into a subterranean formation, wherein the downhole tool is in communication with surface equipment disposed at a wellsite surface from which the wellbore extends; and operating at least one of the downhole tool and the surface equipment to:

pump a volume V of contaminated fluid from the subterranean formation during an elapsed pumping time t while obtaining in-situ, real-time data associated with the contaminated fluid flowing through the downhole tool, wherein the contaminated fluid comprises native formation fluid and oil-based mud (OBM) filtrate;

determine a shrinkage factor b of the contaminated fluid based on the in-situ, real-time data;

fit the contaminated fluid shrinkage factor b relative to either the pumped volume V or the elapsed pumping time t to obtain a function relating the shrinkage factor b with either the pumped volume V or the elapsed pumping time t;

determine a shrinkage factor $b_0$ of the native formation fluid based on the obtained function;

determine a shrinkage factor $b_{OBM}$ of the OBM filtrate; and determine a volume percentage $v_{OBM}$ of the OBM filtrate within the contaminated fluid based on the determined shrinkage factor $b_0$ of the native formation fluid and the determined shrinkage factor $b_{OBM}$ of the OBM filtrate; and further operating the downhole tool based at least in part on the determined volume percentage $v_{OBM}$ of the OBM filtrate.

2. The method of claim 1 further comprising operating at least one of the downhole tool and the surface equipment to determine a formation volume factor $B_o$ based on the in-situ, real-time data, wherein the shrinkage factor b of the contaminated fluid is determined based on the determined formation volume factor $B_o$, and wherein the formation volume factor $B_o$ is determined based on:

a gas-oil-ratio (GOR) of the contaminated fluid determined based on the in-situ, real-time data;

a molecular weight of gas in the contaminated fluid determined based on the in-situ, real-time data;

a density of the contaminated fluid determined based on the in-situ, real-time data; and a density of the contaminated fluid at stock tank conditions determined based on the in-situ, real-time data.

3. The method of claim 1 wherein the function is a power function.

4. The method of claim 1 wherein the function is $b=b_0/\beta V^{-\gamma}$, where, for fitting purposes, $b_0$, $\beta$, and $\gamma$ are adjustable parameters determined via fitting the obtained in-situ, real-time data.

5. The method of claim 4 wherein, for fitting purposes, $b_0$, $\beta$, and $\gamma$ are determined via utilization of at least a portion of:

$$v_{OBM} = \frac{OD_0 - OD}{OD_0 - OD_{OBM}} = \frac{\rho_0 - \rho}{\rho_0 - \rho_{OBM}} = b\frac{GOR_0 - GOR}{GOR_0} = \frac{GOR_0 - GOR}{GOR_0 + (B_{o0} - 1)GOR} = \frac{b - b_0}{b_{OBM} - b_0} = \beta V^{-\gamma}$$

where:

$B_{o0}$ is formation volume factor of the native formation fluid;

$b_{OBM}$ is shrinkage factor of the OBM filtrate;

OD is optical density of the contaminated fluid, which is included in the obtained in-situ, real-time data;

$OD_0$ is optical density of the native formation fluid;

$OD_{OBM}$ is optical density of the OBM filtrate;

GOR is gas-oil-ratio (GOR) of the contaminated fluid;

$GOR_0$ is GOR of the native formation fluid;

$\rho$ is density of the contaminated fluid;

$\rho_0$ is density of the native formation fluid; and $\rho_{OBM}$ is density of the OBM filtrate.

6. The method of claim 1 wherein the function is $b=b_0-\beta t^{-\gamma}$, where, for fitting purposes, $b_0$, $\beta$, and $\gamma$ are adjustable parameters determined via fitting the obtained in-situ, real-time data.

7. The method of claim 1 wherein the shrinkage factor $b_0$ of the native formation fluid is determined utilizing the obtained function by extrapolating the pumped volume V or elapsed pumping time t to infinity.

8. The method of claim 1 wherein the shrinkage factor $b_{OBM}$ of the OBM filtrate is determined by assuming that $b_{OBM}$ is approximately equal to one.

9. The method of claim 1 further comprising measuring density of the OBM filtrate at the wellsite surface, wherein obtaining the in-situ, real-time data includes obtaining density of the OBM filtrate at downhole conditions, and wherein the shrinkage factor $b_{OBM}$ of the OBM filtrate is determined by estimating $b_{OBM}$ based on the OBM filtrate density measured at the wellsite surface and the obtained density of the OBM filtrate at downhole conditions.

10. The method of claim 1 wherein the volume percentage $v_{OBM}$ of the OBM filtrate is determined utilizing:

$$v_{OBM} = \frac{b_0 - b}{b_0 - b_{OBM}}.$$

11. The method of claim 1 wherein the volume percentage $v_{OBM}$ of the OBM filtrate is determined utilizing:

$$v_{OBM} = \frac{b_0 - b}{b_0 - 1}.$$

12. An apparatus, comprising:

a downhole tool operable within a wellbore extending from a wellsite surface into a subterranean formation; and surface equipment disposed at the wellsite surface and in communication with the downhole tool, wherein the downhole tool and the surface equipment are individually or collectively operable to perform each of:

pumping a volume V of contaminated fluid from the subterranean formation during an elapsed pumping time t while obtaining in-situ, real-time data associated with the contaminated fluid flowing through the downhole tool, wherein the contaminated fluid comprises native formation fluid and oil-based mud (OBM) filtrate;

determining a shrinkage factor b of the contaminated fluid based on the in-situ, real-time data;

fitting the contaminated fluid shrinkage factor b relative to either the pumped volume V or the elapsed pumping time t to obtain a function relating the shrinkage factor b with either the pumped volume V or the elapsed pumping time t;

determining a shrinkage factor $b_0$ of the native formation fluid based on the obtained function;

determining a shrinkage factor $b_{OBM}$ of the OBM filtrate; and determining a volume percentage $v_{OBM}$ of the OBM filtrate within the contaminated fluid based on the determined shrinkage factor $b_0$ of the native formation fluid and the determined shrinkage factor $b_{OBM}$ of the OBM filtrate.

13. The apparatus of claim 12 wherein the function is a power function.

14. The apparatus of claim 12 wherein the function is $b=b_0-\beta V^{-\gamma}$, here, for fitting purposes, $b_0$, $\beta$, and $\gamma$ are adjustable parameters determined via fitting the obtained in-situ, real-time data.

15. The apparatus of claim 12 wherein the function is $b=b_0-\beta t^{-\gamma}$, where, for fitting purposes, $b_0$, $\beta$, and $\gamma$ are adjustable parameters determined via fitting the obtained in-situ, real-time data.

16. The apparatus of claim 12 wherein the shrinkage factor $b_0$ of the native formation fluid is determined utilizing the obtained function by extrapolating the pumped volume V or elapsed pumping time t to infinity.

17. The apparatus of claim 12 wherein the shrinkage factor $b_{OBM}$ of the OBM filtrate is determined by assuming that $b_{OBM}$ is approximately equal to one.

18. The apparatus of claim 12 wherein the downhole tool and the surface equipment are individually or collectively operable to measure density of the OBM filtrate at the wellsite surface, wherein obtaining the in-situ, real-time data includes obtaining density of the OBM filtrate at downhole conditions, and wherein the shrinkage factor $b_{OBM}$ of the OBM filtrate is determined by estimating $b_{OBM}$ based on the OBM filtrate density measured at the wellsite surface and the obtained density of the OBM filtrate at downhole conditions.

19. An apparatus, comprising:

a downhole tool operable within a wellbore extending from a wellsite surface into a subterranean formation, wherein the downhole tool comprises a first non-transitory, computer-readable storage medium having a first program code stored thereon; and surface equipment disposed at the wellsite surface and in communication with the downhole tool, wherein the surface equipment comprises a second non-transitory, computer-readable storage medium having a second program code stored thereon;

wherein the first and second program codes individually or collectively include instructions individually or collectively executable by the downhole tool and the surface equipment for performance of each of:

pumping a volume V of contaminated fluid from the subterranean formation during an elapsed pumping time t while obtaining in-situ, real-time data associated with the contaminated fluid flowing through the downhole tool, wherein the contaminated fluid comprises native formation fluid and oil-based mud (OBM) filtrate;

determining a shrinkage factor b of the contaminated fluid based on the in-situ, real-time data;

fitting the contaminated fluid shrinkage factor b relative to either the pumped volume V or the elapsed pumping time t to obtain a function relating the shrinkage factor b with either the pumped volume V or the elapsed pumping time t;

determining a shrinkage factor $b_0$ of the native formation fluid based on the obtained function;

determining a shrinkage factor $b_{OBM}$ of the OBM filtrate; and determining a volume percentage $v_{OBM}$ of the OBM filtrate within the contaminated fluid based on the determined shrinkage factor $b_0$ of the native formation fluid and the determined shrinkage factor $b_{OBM}$ of the OBM filtrate.

20. The apparatus of claim 19 wherein:

the function is a power function;

the shrinkage factor $b_0$ of the native formation fluid is determined utilizing the obtained function by extrapolating the pumped volume V or elapsed pumping time t to infinity;

the shrinkage factor $b_{OBM}$ of the OBM filtrate is determined by assuming that $b_{OBM}$ is approximately equal to one; and the volume percentage $v_{OBM}$ of the OBM filtrate is determined utilizing:

$$v_{OBM} = \frac{b_0 - b}{b_0 - 1}.$$

* * * * *